United States Patent [19]

Kobler et al.

[11] Patent Number: 4,599,956

[45] Date of Patent: Jul. 15, 1986

[54] BORER APPARATUS FOR AN EMBROIDERING MACHINE

[75] Inventors: Armin Kobler, Arbon; Peter Josuran, Goldach, both of Switzerland

[73] Assignee: Aktiengesellschaft Adolph Saurer, Arbon, Switzerland

[21] Appl. No.: 797,387

[22] Filed: Nov. 12, 1985

[30] Foreign Application Priority Data

Nov. 22, 1984 [CH] Switzerland ..... 5583/84

[51] Int. Cl.[4] ..... D05C 7/04

[52] U.S. Cl. ..... 112/89

[58] Field of Search ..... 112/83, 85, 89, 98

[56] References Cited

U.S. PATENT DOCUMENTS 268,170 11/1882 Baum ..... 112/89

FOREIGN PATENT DOCUMENTS 212125 4/1960 Austria ..... 112/85

580188 9/1976 Switzerland ..... 112/89

*Primary Examiner*—Henry S. Jaudon

*Assistant Examiner*—Andrew M. Falik

*Attorney, Agent, or Firm*—Werner W. Kleeman

[57] ABSTRACT

The borer apparatus for an embroidering machine comprises a device for removably mounting an exchangeable borer implement on a borer support. The exchangeable borer implement is secured against rotation and is axially fixed by a pivotable hairpin spring which facilitates the replacement of the exchangeable borer implement. The exchangeable borer implement is inserted with its shaft into a sliding or close fitting bore in the borer support and a stop member in the close fitting bore engages an end or head groove of the shaft of the exchangeable borer implement. The shaft is subjected to the action of the hairpin spring in order to secure such shaft against inadvertent rotation. The stop member in the close fitting bore is formed by a pin or sleeve which penetrates and protrudes out of at least one side of the borer support and whose free end forms a biasing stop for the free end of the outwardly pivotably positioned hairpin spring which fixes the exchangeable borer implement in an axial direction. The hairpin spring has a clamping shank which engages a contact surface on the shaft of the exchangeable borer implement. The contact surface extends vertically in relation to the longitudinal roll axis of the exchangeable borer implement.

9 Claims, 3 Drawing Figures

BORER APPARATUS FOR AN EMBROIDERING MACHINE

BACKGROUND OF THE INVENTION

The present invention broadly relates to embroidering machines and, more specifically, pertians to a new and improved construction of a borer apparatus for an embroidering machine.

In its more particular aspects the present invention relates to a borer apparatus for an embroidering machine. The borer apparatus comprises means for the removable mounting of at least one exchangeable borer implement on a borer support member or support, such as a borer beam or a borer rail of the embroidering machine. The mounting means also secures the exchangeable borer implement against inadvertent rotation. Each exchangeable borer implement is inserted with its shaft into a sliding or close fitting bore in the borer support. A first stop member projecting into the close fitting bore cooperates with a slot in the shaft of the exchangeable borer implement to secure the shaft of such exchangeable borer implement against inadvertent rotation.

A substantial problem with borer apparatuses of the aforementioned type consists in constructing the mount of the exchangeable borer implement on the embroidering machine in such a manner that the cutting edges of the borers are precisely vertically and horizontally oriented and such that all borer tips, with respect to their lengths and their positions, are stationarily or fixedly positioned to a precision of fractions of millimeters in order that qualitatively superior merchandise can be manufactured.

Optimally this can be achieved if all borer implements are permanently screwed into the borer support or rail of the machine and are all ground or sharpened together in the borer support or rail. However, such fixed arrangements permit neither an efficient or economical pattern change nor a suitable replacement or exchange of the borer implements. Furthermore, such arrangements are in stark contrast to modern designs of embroidering machines with embroidering station engagement means for activating and deactivating any desired combination of embroidering stations.

So-called exchangeable borer implement arrangements for achieving or effecting a better pattern change as well as for achieving or effecting an easier replacement or exchange of exchangeable borer implements have proved successful. In these arrangements, each exchangeable borer implement is inserted with its shaft into a close fitting bore formed in the borer support or beam or in the borer rail and is secured by a suitable means against inadvertent rotation and inadvertent axial movement.

This type of exchangeable borer implement arrangement is known from the Swiss Patent No. 580,188 in which close fitting bores for the acceptance of an exchangeable borer implement are each formed in an associated one of a number of sockets threaded or screwed to and adjusted in the borer support or beam or in the borer rail. The cylindrical shaft of each exchangeable borer implement is plugged or inserted into this associated socket. A C-shaped leaf spring loop, retaining the threaded shaft of the borer socket and which is held in frictional engagement onto the borer support by the screw of the screwed or threaded-in socket, serves to fix or secure the inserted exchangeable borer implement against inadvertent rotation and inadvertent axial movement. A free-standing, outwardly bent or angled shank of the C-shaped leaf spring loop grips or surrounds the exchangeable borer implement in positive engagement and under spring tension in the area of its base. For this purpose, the exposed shank of the C-shaped leaf spring loop features a notch which corresponds to the profile of the exchangeable borer implement at the contact point or location of the C-shaped leaf spring clip.

An exchangeable borer implement arrangement is known from Swiss Patent No. 103,867 in which close fitting bores for the acceptance of an exchangeable borer implement are each formed in a respective one of a number of screwed-in sockets in the borer support or beam or in the borer rail. However, these close fitting bores are not cylindrical as in the aforementioned known arrangement, but are conical. Correspondingly, the exchangeable borer implements in this latter known arrangement are equipped with conical borer shafts. Each exchangeable borer implement features two recesses or flats on the base or shank which are used when inserting and adjusting the exchangeable borer implement as well as when releasing the conical connection between the exchangeable borer implement and the socket by means of a key which engages the locations between these two recesses.

A yet further exchangeable borer implement arrangement known in practical operation provides, for each exchangeable borer implement, a stud which is connected with a borer support or beam or with a borer rail in a suitable manner, e.g. in this case, screwed-in cylindrical studs are provided for each exchangeable borer implement onto which the respective exchangeable borer implement can be plugged by means of a corresponding complementing bore in its shaft. A pivotable spring, featuring a clamping shank, engages the exchangeable borer implement and fixes or secures it against rotary and axial movement on the borer support or beam or rail. The protection against inadvertent rotation is implemented here in that the spring engages, with its clamping shank or member, a sloping surface of a cross or diagonal groove on the shaft of the exchangeable borer implement.

These known arrangements can only very limitedly fulfill the required conditions, namely the precise positioning of the exchangeable borer implement under all operational conditions and especially also after long periods of use. The relatively short thread of the sockets for the plug connector as well as the additional plug connector between the socket and the exchangeable borer implement are causes of intolerable inaccuracies in the positioning of the exchangeable borer implement along the longitudinal axis. Additionally, the known types of protection against inadvertent rotation are less than adequate, whether they function by means of a clamping spring engaging a cross or diagonal groove in the shaft of the exchangeable borer implement or by means of a spring enclosing the foot of the exchangeable borer implement. A further disadvantage is that the springs each exert a transverse force on the exchangeable borer implement which further influences the positioning of the exchangeable borer implement. An additional risk associated with the known conical connection is that individual exchangeable borer implements can inadvertently release or disengage depending on the operational conditions and on the care exercised in inserting the exchangeable borer implement.

These disadvantages are circumvented in an exchangeable borer implement arrangement known from Swiss Patent No. 549,682. Here, the exchangeable borer implements, which have cylindrical shafts, are inserted directly into close fitting bores in the borer rail. The close fitting bores for the exchangeable borer implements intersect other bores in the borer rail which each accept a screw. The part of the shaft inserted in the close fitting bore features a flat or flattened region against which presses a conical surface of the screw which is screwed into the borer rail in order to connect the exchangeable borer implement with the rail in an accurately oriented position. This known solution has the following substantial flaws or shortcomings. The fixation by means of a screw requires a large expenditure of time when the exchangeable borer implement is replaced, and as a consequence of frequent replacement of exchangeable borer implements the very fine thread is subject to excessive wear. The stop which determines the axial insertion depth of the exchangeable borer implement is formed by an inclined flank or ramped termination of the flat or flattened region. It is therefore not suitable for a precise axial positioning of the exchangeable borer implement.

SUMMARY OF THE INVENTION

Therefore, with the foregoing in mind, it is a primary object of the present invention to provide a new and improved construction of a borer apparatus for an embroidering machine which does not exhibit the aforementioned drawbacks and shortcomings of the prior art constructions.

Another and more specific object of the present invention aims at providing a new and improved construction of a borer apparatus for an embroidering machine of the previously mentioned type in which every exchangeable borer implement is inserted with its shaft into a close fitting bore in the borer support, such as a beam or borer rail, whereby a stop member projecting into the close fitting bore cooperates with a slot in the shaft of the exchangeable borer implement to secure the shaft of the exchangeable borer implement against inadvertent rotation.

In keeping with the foregoing object, a further object of the present invention is to facilitate replacement of the exchangeable borer implement and to achieve an optimum location of the same on the borer support while securing the exchangeable borer implement against inadvertent rotation.

Now in order to implement these and still further objects of the invention, which will become more readily apparent as the description proceeds, the apparatus of the present invention is manifested by the features that the first stop member in the close fitting bore is formed by a dowel or a pin, such as a solid pin or a roll pin, which penetrates the borer support or support member, constituted by a beam or borer rail. There is provided an end or head groove or slot in the shaft of the exchangeable borer implement. A free end of the pin projecting from the borer support member forms a biasing stop for the free end of a pivotably positioned C-spring or hairpin spring which fixes the exchangeable borer implement in an axial direction in a known manner. The hairpin spring engages with its clamping shank or member a pressure or contact surface on the shaft of the exchangeable borer implement and which contact surface extends vertically or at right angles in relation to the longitudinal roll axis of the exchangeable borer implement.

The first stop member, which engages the end or head groove or slot of the shaft of the exchangeable borer implement which itself is subjected to the action of the hairpin spring, guarantees an optimum location of the exchangeable borer implement in the direction of the longitudinal axis in the close fitting bore and simultaneously an optimum protection against inadvertent rotation over an extended operational period.

The use of the part forming the first stop member in the close fitting bore simultaneously as a biasing stop for the hairpin spring results furthermore in an especially practical and simple design of economical components. Undesired transverse forces acting on the exchangeable borer implement are avoided in that the hairpin spring engages with its clamping shank or member the pressure or contact surface on the shaft of the exchangeable borer implement and which surface extends vertically or at right angles in relation to the longitudinal roll axis of the exchangeable borer implement.

In order to achieve a simplified actuation of the hairpin spring when replacing the exchangeable borer implement, it is advantageous for the free end of the hairpin spring to be formed such that it can be actuated by means of an auxiliary tool.

In order that the hairpin spring can be easily and stably mounted and supported on the borer support, it is additionally advantageous, according to a further embodiment of the invention, for the borer support to be penetrated by a further pin, such as a solid pin or roll pin, serving as a second stop member which extends parallel to the first stop member of the exchangeable borer implement and for the free end of the further pin serving as the second stop member to serve as a rotary bearing or support for the bearing or support eyes formed by the ends of the clamping shank of the hairpin spring.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
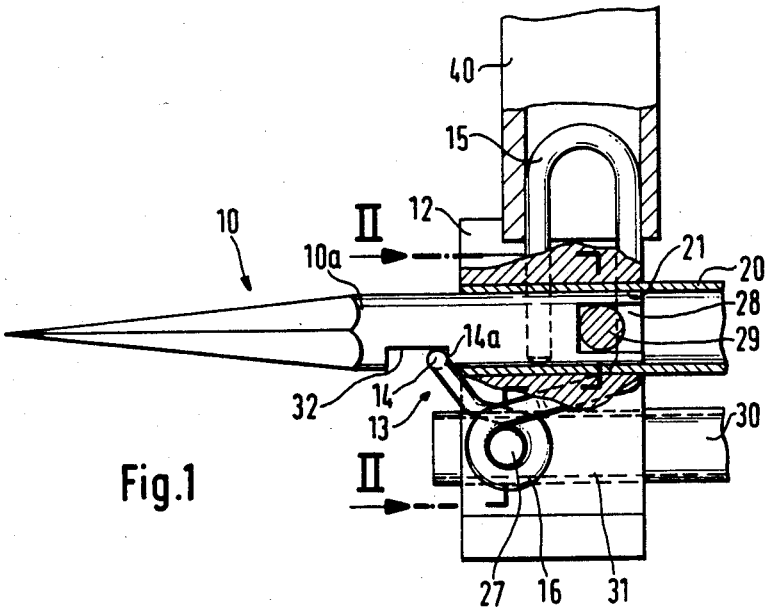
FIG. 1 schematically illustrates in partial cross-section a side view of a first exemplary embodiment of the borer apparatus according to the invention.

Describing now the drawings, it is to be understood that to simplify the showing thereof only enough of the structure of the borer apparatus has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise an exchangeable borer implement 10, having a shaft 10*a* which is directly inserted into a close fitting or sliding bore 21 of a borer support or support member, such as a borer beam 12 (FIGS. 1 and 2) or a borer rail 2 (FIG. 3) and is, as will be explained in greater detail later, held in the illustrated position by a C-spring or hairpin spring 13 acting upon the borer shaft 10*a*. The borer shaft 10*a* is formed with an end or head groove or slot 28. When an exchangeable borer implement 10 is inserted or mounted, the end or head groove 28 is penetrated by a first stop member 29 which passes through the close fitting bore 21. The exchangeable borer implement 10 is pressed against the first stop member 29 due to the action or effect of the hairpin spring 13.

Figure 2:
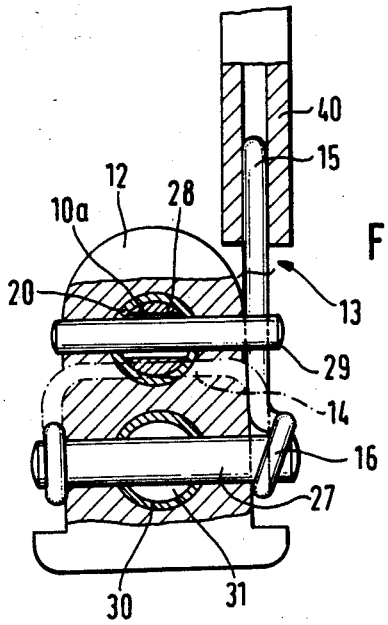
FIG. 2 schematically illustrates another view of the first exemplary embodiment of the borer apparatus according to the invention, in a partial cross-section taken along the section line marked II—II in FIG. 1.
Figure 3:
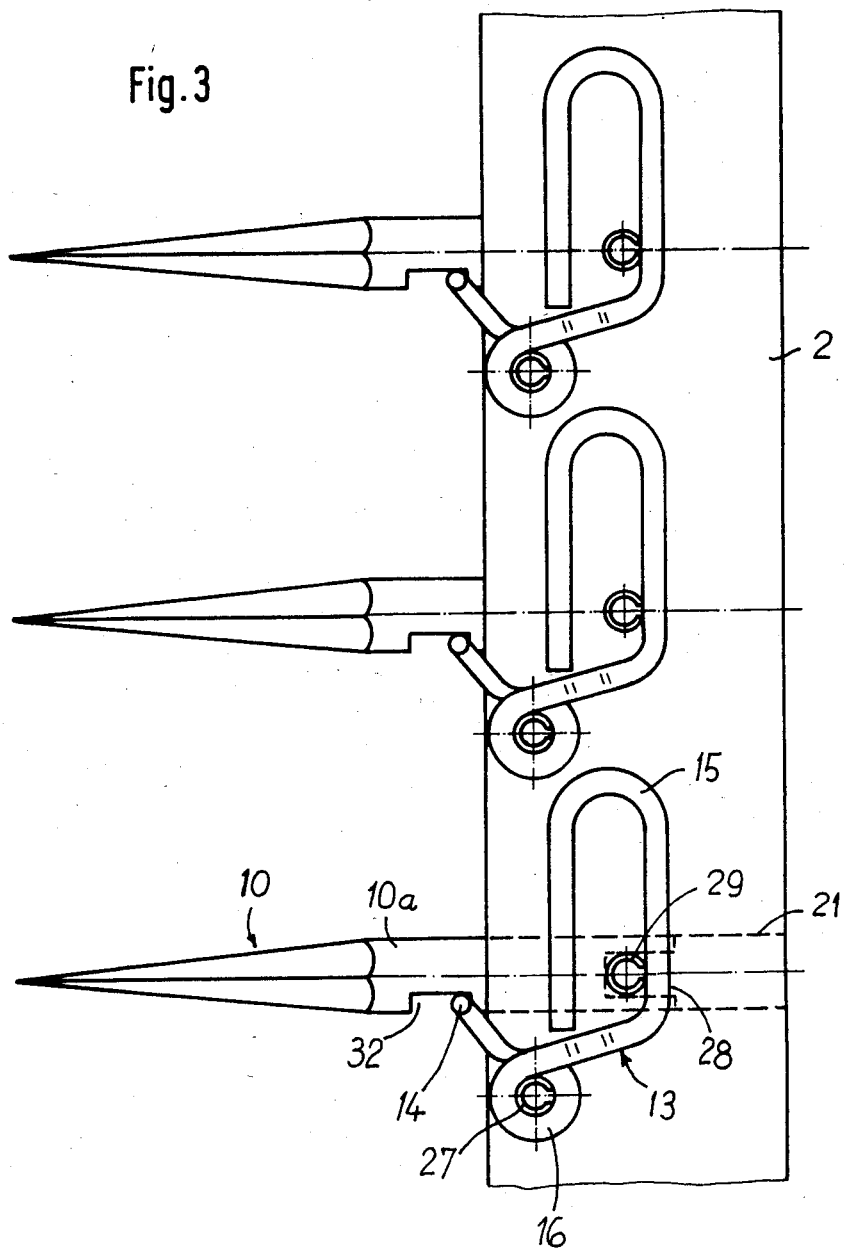
FIG. 3 schematically illustrates a further exemplary embodiment of a borer apparatus according to the invention with a plurality of exchangeable borer implements according to the invention and mounted on a borer rail.

As can be clearly ascertained from FIGS. 1 to 3, this arrangement ensures an optimum longitudinal axial location of the exchangeable borer implement 10 and protection against inadvertent rotation of such exchangeable borer implement 10 on the borer beam 12 or the borer rail 2. The hairpin spring 13 cannot exert any transverse force on the exchangeable borer implement 10 since the clamping shank or member 14 of the hairpin spring 13 engages a pressure or contact surface 14*a* on the shaft of the exchangeable borer implement 10 extending substantially vertically or at right angles in relation to the longitudinal roll axis of the exchangeable borer implement 10. This pressure or contact surface 14*a* can, as illustrated, be a flank of a groove or recess 32.

The first stop member 29 in the close fitting bore 21 can be a solid pin or dowel as shown in FIGS. 1 and 2 or can be a slotted tubular member or so-called roll pin as shown in FIG. 3. This first stop member 29 penetrates the borer beam 12 or the borer rail 2 and, as can be recognized from FIGS. 2 and 3, one end thereof projects from the borer beam 12 or from the borer rail 2, so that the first stop member 29 simultaneously serves as a biasing stop for a free end 15 of the hairpin spring 13. Furthermore, this free end 15 is so formed that it can be easily pressed or engaged for actuation by an auxiliary tool 40.

For the pivotable location of the hairpin spring 13, the borer beam 12 (FIGS. 1 and 2) or the borer rail 2 (FIG. 3) is penetrated by a further pin, such as a solid pin or roll pin, serving as a second stop member 27 which extends parallel to the first stop member 29. The free end of the further pin serving as a second stop member 27 serves as a rotary bearing or support for the bearing or support eyes formed by the ends of the clamping shank 14 of the hairpin spring 13. Furthermore, this further pin defining the second stop member 27 can form a stop in a further bore 31 extending substantially parallel to the close fitting bore 21. The further bore 31 contains an inserted sleeve 30 for accommodating a suitable needle (not illustrated).

For improved guidance, a sleeve 20 can be forcibly inserted or pressed into the close fitting bore 21 for the accommodation or insertion of the borer shaft 10*a*. As illustrated in FIG. 1, this sleeve 20 can project rearwardly from the borer beam 12 and serve as a movable or slidable support for the borer apparatus on the embroidering machine if the borer apparatus is to be used for machines with embroidering station engagement means.

A borer apparatus which allows an optimization of all previously mentioned requirements in the simplest possible concept ensues from the foregoing teachings of the preceding description.

It will be understood that a number of modifications are possible within the concepts and teachings of the present invention. In particular, the biasing spring can be supported differently and can also have a different configuration so long as the biasing spring is in the appropriate position to press the exchangeable borer implement in the close fitting bore against the first stop member.

While there are shown and described present preferred embodiments of the invention, it is to be distinctly understood that the invention is not limited thereto, but may be otherwise variously embodied and practiced within the scope of the following claims. Accordingly,

What we claim is:

1. A borer apparatus for an embroidering machine, comprising:

a borer support member;

at least one exchangeable borer implement releasably and exchangeably mountable in said borer support member and secured against rotation in relation thereto;

said at least one exchangeable borer implement having a shaft and a longitudinal axis;

said borer support member being provided with at least one bore for each said at least one exchangeable borer implement;

said shaft of each said at least one exchangeable borer implement engaging said at least one bore with a close fit;

said shaft being provided with a recess and an end slot;

a first stop member protruding transversely into at least one bore and engaging said recess of said shaft for securing said shaft against rotation relative to said borer support member;

said first stop member protruding into said at least one bore comprising a first pin member;

said first pin member penetrating said borer support member and said end slot of said shaft;

said first pin member having a free end;

outwardly pivotably journalled spring means for axially securing said at least one exchangeable borer implement;

said spring means having a free end;

said free end of said first pin member protruding from said borer support member for forming a biasing stop for said free end of said spring means;

said spring means having a clamping shank;

said recess of said shaft having a contact surface extending substantially perpendicular to said longitudinal axis of said at least one exchangeable borer implement; and said clamping shank of said spring means engaging said contact surface.

2. The borer apparatus as defined in claim 1, further including:

said free end of said spring means being constructed to be actuated by an auxiliary tool.

3. The borer apparatus as defined in claim 1, further including a sleeve; and said sleeve being pressed into said at least one bore.

4. The borer apparatus as defined in claim 3, further including:

a further sleeve extending substantially parallel to said sleeve; and said further sleeve protruding rearwardly from said borer support member for axially guiding the borer apparatus in the embroidering machine.

5. The borer apparatus as defined in claim 4, wherein:

said further sleeve serves for accommodating a needle.

6. The borer apparatus as defined in claim 1, further including:

a second stop member having a free end;

said borer support member being penetrated by said second stop member;

said second stop member extending substantially parallel to said first stop member;

said clamping shank of said spring means having two ends; a bearing eye being formed at each of said two ends of said clamping shank; and said free end of said second stop member serving as a rotary bearing journal for said bearing eyes.

7. The borer apparatus as defined in claim 6, wherein:

said second stop member comprises a substantially cylindrical solid pin.

8. The borer apparatus as defined in claim 6, wherein:

said second stop member comprises a slotted tubular sleeve.

9. The borer apparatus as defined in claim 8, wherein:

said slotted tubular sleeve comprises a roll pin.

* * * * *